US006128905A

United States Patent [19]

Fahlsing

[11] Patent Number: 6,128,905

[45] Date of Patent: Oct. 10, 2000

[54] BACK PRESSURE OPTIMIZER

[75] Inventor: Paul M. Fahlsing, Wilsonville, Oreg.

[73] Assignee: Pacificorp, Portland, Oreg.

[21] Appl. No.: 09/191,735

[22] Filed: Nov. 13, 1998

[51] Int. Cl.[7] ..... F01K 9/00

[52] U.S. Cl. ..... 60/661; 60/686

[58] Field of Search ..... 60/686, 660, 661

[56] References Cited

U.S. PATENT DOCUMENTS

| | | | |
|---|---|---|---|
| 308,756 | 12/1884 | Dingley . | |
| 1,719,138 | 7/1929 | Roucka . | |
| 2,261,584 | 11/1941 | Knowlton et al. | 257/2 |
| 4,165,616 | 8/1979 | Pierpoline | 60/686 |
| 4,190,102 | 2/1980 | Gerz | 165/113 |
| 4,272,962 | 6/1981 | Viscovich et al. | 60/648 |
| 4,620,588 | 11/1986 | Pfouts et al. | 165/32 |
| 4,642,992 | 2/1987 | Julovich | 60/686 X |
| 4,736,590 | 4/1988 | Monticelli, Jr. | 60/686 X |
| 4,765,946 | 8/1988 | Dagard et al. | 376/282 |
| 4,958,679 | 9/1990 | Drosdziok et al. | 60/686 X |
| 5,005,351 | 4/1991 | Archer | 60/686 |
| 5,385,202 | 1/1995 | Dorsdziok et al. | 165/1 |
| 5,632,329 | 5/1997 | Fay | 165/113 |

OTHER PUBLICATIONS

Fahlsing, Paul M., "VFD retrofit provides 3.75–MW boost to air–cooled Wyodak Power Plant," *Power Engineering* vol. 100, No. 05, May 1996.

"Operations and Maintenance Instructions Lummusaire Air-cooled Steam Condenser".

"Operating Experience and Performance Testing of the World's Largest Air–Cooled Condenser".

Larinoff, Michael W., "Can you air–cooled condenser handle the big chill," *Fossil–Fired Steam/Electric*, Jan./Feb. 1997.

Fahlsing, Paul M., P.E., "Benefits of Variable Speed Drives Applied on Dry Condensing at the Wyodak Plant," *Joint Power Generation Conference*, PWR–vol. 28, 1995 vol. 3 ASME 1995.

Product Literature entitled: "Evolving from the 90's to the next century . . . ," *Strategic Enterprise Management*, Elsag Baily Process Automation.

Product Literature entitled: "INFI 90 Open: The Cornerstone of Strategic Enterprise Management," Elsag Baily Process Automation.

Product Literature entitled: "Global Partners for Precess Automation," Elsag Baily Process Automation.

*Primary Examiner*—Hoang Nguyen
*Attorney, Agent, or Firm*—Kirton & McConkie

[57] ABSTRACT

The present invention is directed toward a method and device for increasing the energy efficiency of a power plant. The invention comprises monitoring the power consumption of a power plant subsystem. The subsystem being monitored should be a subsystem that directly influences a measurable condition that is related to generator output. The generator output of the power plant generator is monitored as a function of the measurable condition. The power consumption of the subsystem influencing the measurable condition is compared to generator. The subsystem power consumption can then be adjusted output.

7 Claims, 5 Drawing Sheets

BACK PRESSURE OPTIMIZER

BACKGROUND

1. Field of the Invention

This invention relates to a method and device for increasing the energy efficiency of a power plant. More specifically it relates to a method and a device which optimizes the back pressure in an air-cooled condenser to more efficiently regulate the power consumed in operating an air-cooled condenser.

2. Background Art

Some power plants create electricity by burning fuel to create intense heat. The heat is used to vaporize liquid water running in pipes near the heat source such as a boiler 10 to generate steam. The steam inside the pipes is under great pressure and is directed to pass over and drive the blades of a turbine generator 12. The steam forces the turbine generator to spin thereby creating electricity. See FIG. 1.

Some of the electricity created by such a power plant is used to operate subsystems of the power plant itself. Power plants can have numerous subsystems in their designs such as boilers, steam condensers, offices and shops. While some of the subsystems consume a portion of the electricity the power plant creates, many are designed to increase the power plant's net electrical output. Power plant subsystems which operate using electricity from the plant, such as an air-cooled condenser 14, have an optimum level or set point at which the subsystem functions with the greatest energy efficiency under various conditions.

Achieving optimal energy efficiency in a subsystem and maintaining it are longstanding problems. In order to monitor and evaluate subsystem energy efficiency, the electrical consumption of the subsystem and the electrical output of the generators are simultaneously monitored and evaluated in relation to each other. If the subsystem is not running efficiently, appropriate adjustments should be made. It is advantageous if the subsystem being monitored provides means for adjusting the power consumption to various levels. If the subsystem being monitored provides only limited means for adjusting power consumption, it is more difficult to run the subsystem efficiently. Subsystems for which power consumption can be readily and selectively adjusted and varied can be operated more efficiently.

An air-cooled condenser 14 of a power plant is a subsystem that consumes plant energy and that increases the power plant's net electrical output by its design and efficient operation. Air-cooled condensers cool steam after the steam has been used to drive the generators, thereby condensing the steam into liquid water and conducting it back to the heat source where it is used again. As steam leaves the turbine generator, the steam is still under pressure and is conducted into condensing tubes 16 where the steam is allowed to cool and to condense. In order to take advantage of natural cooling, condensers and condensing tubes are typically placed out-of-doors, or in a location where the surrounding ambient air, wind and weather can be utilized to cool the condensing tubes. The speed of the condensing process can be increased by lowering the temperature of the condensing tubes through which the steam flows. In an air-cooled condenser, large industrial fans 18 can be positioned near the condensing tubes to create additional air flow over the condensing tubes to lower the temperature of condensing tubes. See FIG. 2. Running the fan motors of the large condenser fans accounts for most of the electricity consumed by the condenser subsystem. Because of the significant amount of electricity used to operate condensers, great efforts are made to make the condensers energy efficient. Select air-cooled condensers are configured with means for adjusting and varying power consumption of the condenser. However, if the condensing subsystem does not operate efficiently, excess energy is consumed, thereby reducing the plant's net electrical output.

The main parts of a typical air-cooled condenser system include a main steam header, steam condensing tubes, large fans, water pipes and an air ejector system. The main header is a conduit that carries the steam from the generator turbines to the steam condensing tubes. Once the steam is in the condensing tubes, the condensing tubes, and consequently the steam inside the condensing tubes, are cooled by the large fans so that the desired amount of steam condenses again into liquid water. Water pipes connected to the base of the condensing tubes collect the condensed water and conduct it back to the power plant's heat source. An air ejector system (AES) 20 evacuates uncondensed gases from the condensing tubes and ejects them from the condenser subsystem. See FIG. 1.

Using a condenser to condense steam exhausted from the generator turbine has a significant limitation. If the steam is not sufficiently condensed and/or uncondensed gases are not ejected quickly enough, then as the turbine continues to exhaust steam, pressure on the exhaust side of the turbine builds. This pressure, called back pressure, can work against the turbine actually causing a resistance to the desired operation of the turbine, decreasing the work output, thereby decreasing the electrical output of the generator and the plant.

To help regulate back pressure build up, the back pressure in the system is monitored and regulated in prior art techniques by physically measuring actual back pressure and comparing it to a preselected, calculated value for back pressure, called the back pressure set point. The back pressure set point can be selected by the operator. The back pressure set point regulates back pressure by changing the rate of cooling and condensing in the condenser subsystem by controlling the condenser fan speed. Condenser back pressure is monitored and when the actual back pressure is lower than the desired, predetermined set point, condenser fan speed is lowered, allowing back pressure to increase. Conversely, when the actual back pressure exceeds the desired, predetermined back pressure set point, the condenser fan speed is increased to accelerate cooling and condensing of the steam, thereby reducing back pressure. However, increasing the fan speed also increases electrical consumption which may reduce the net electrical output of the plant. A longstanding problem resides in attempting to optimize back pressure so the turbine generators, condensers and fans are operating at optimum energy efficiencies.

Some condensers use fans having variable speed fan motors which allow the fan speed to be adjusted very precisely. Other condensers may use fan motors which provide one or only a few discrete settings for fan speed. Without a variable speed motor on the fan, the fine adjustments to the fan speed necessary for the fans to run most efficiently are more difficult to make. Variable speed fans allow the operator to adjust the fan speed precisely for the most efficient use of the fan. The variable speed fans are able to efficiently cool the condensing tubes so the steam in each tube cools as it rises up through the length of the tube.

Even with variable speed fans, an air-cooled condenser is operated inefficiently when more energy is used for fan speed increase than is gained by reducing back pressure. For example, if the back pressure is significantly limiting generator output, an operator may choose to reduce the back pressure in order to produce more electricity. Back pressure is reduced by increasing the fan speed of the condenser fans. However, running the fans at higher speeds consumes more electricity. At some point the extra energy gained by reducing back pressure is equal to the extra energy consumed by running the fans at higher speeds. Beyond that point, reducing back pressure any further by increasing fan speeds actually decreases the net electrical output because the fans use more electricity than they save by reducing back pressure. In other words, there are conditions when running fans at higher speeds consume more energy than is created by the corresponding reduction in back pressure.

Similarly if the amount of steam flowing into and driving the turbine is increased to increase generator output, the condenser subsystem cooling rate may have to be increased to condense the additional steam entering the condenser subsystem. After the generator reaches its optimal net output, any incremental gain in generator output is offset by an equal power loss or consumption required to operate the condenser subsystem at the rate needed. When the incremental power increase to operate the condenser subsystem exceeds the incremental increase in generator output, the generator is no longer operating in an efficient range and net power output actually decreases with each increase in gross generator output.

In order to increase the efficiency of a condenser subsystem, the generator output of the plant and the power consumed by the condenser subsystem are directly measured, monitored, compared, and adjusted by prior art techniques to run the subsystem more efficiently. If monitoring and comparing actual generator output to power consumption shows the subsystem is consuming more power than it saves, then adjustments are made to increase the subsystem's efficiency.

In attempting to monitor generator output and the power consumption, it is well known that the readings for these conditions can fluctuate frequently. The source of the fluctuations may be conditions such as existing, ambient temperature and wind conditions around the condenser(s). When ambient temperatures are low and wind speeds are high the condenser functions differently than when temperatures are high and wind speeds are low. Thus, in order to monitor generator output and power consumption the fluctuations in the actual generator output and the subsystem power consumption can be monitored and compared to help regulate the efficiency of the subsystem. More specifically, the range of the fluctuation of the actual generator output may be compared to the range of the fluctuation of the power consumption.

Monitoring the actual generator output and comparing it to the subsystem power consumption offers some indication of the efficiency of the power consumption by the subsystem, but monitoring actual generator output has a significant disadvantage. Monitoring the actual generator output provides a generator output reading that is also influenced by uncontrollable external factors such as boiler temperature, pre-exhaust steam quantity and flow rates of various other subsystems within the power plant. These external factors affecting actual generator output value are not necessarily related to the efficiency of controllable subsystems. When external factors influence the value used to determine generator output, they compromise the ability to accurately monitor the effect of the controllable subsystem on generator output. Depending on the subsystem being monitored, other external factors might also include the main steam pressure, the reheat spray flows, boiler conditions, and changes in the heat transfer. For example, the external factors causing variations in generator output may be wholly unrelated to the power consumption of the condenser subsystem being monitored for efficiency. External factors make it difficult to determine whether fluctuations in the generator output are related to fluctuations in condenser efficiency. Therefore, monitoring actual generator output is not the most reliable method for evaluating condenser efficiency.

What is needed is a method for monitoring generator output relative to the power consumption of a controllable subsystem such as the condensing subsystem which method more effectively isolates the monitoring of generator output from external factors which are not related to the subsystem efficiency. The isolated generator output value can then be compared to the subsystem power consumption, and the subsystem can be regulated accordingly.

OBJECTS AND BRIEF SUMMARY OF THE INVENTION

It is an object of the present invention to provide a method and device that more effectively isolates the monitoring of the generator output relative to the power consumption of a related subsystem independent of external factors not related to subsystem efficiency.

It is an object of the present invention to provide a method and device that achieves and maintains optimum operation of an air-cooled condenser relative to the output of power generators by regulating the power consumption of the condenser.

The present invention is a method and device for more efficiently operating controllable subsystems which contribute to the net electrical output of a power plant. The invention provides for monitoring generator output as a function of one or more related measurable conditions. The measurable conditions have a quantifiable relationship to generator output and are directly influenced by the subsystem being monitored for energy efficiency. Using a measurable, quantifiable condition, the generator output value is obtained or calculated. The calculated generator output value is relatively isolated from external factors which are not related to or influenced by the subsystem. The calculated generator output value is then compared with the power consumption of the subsystem. Such a comparison may include comparing the standard deviation of the calculated generator output with the standard deviation of the power consumption. Having compared the calculated generator output to power consumption, adjustments can be made to the controllable subsystem which allow the subsystem to operate more energy efficiently.

Adjustments allowing the subsystem to run efficiently can be made directly to the subsystem or indirectly. The adjustment can also be made using an optimizer value. The optimizer value is a calculated value which indicates specifically how the subsystem should be operated to optimize efficiency. To prevent the present invention from inappropriately adjusting the subsystem, the invention provides means for limiting improper regulation by the invention. The present invention provides means for preventing inaccurate negative optimizer values from inhibiting the operation of a back pressure optimizer. It also provides means for limiting the range of adjustment made using the optimizer value.

In one preferred embodiment, the controllable, adjustable subsystem is an air-cooled condenser subsystem. To more efficiently run an air-cooled condenser, the standard deviation of the power consumption of the fan motors is monitored and compared to the standard deviation of a calculated generator output. Back pressure is the measurable condition used to calculate the generator output because back pressure is directly related to generator output and is significantly influenced by the air-cooled condenser. Based on the calculated generator output and the condenser power consumption, the invention regulates the rate of cooling of the condenser subsystem in a manner which yields greater efficiency by achieving and maintaining optimum condenser operation and specifically optimum back pressure influencing both the generator and the operation of the condenser subsystem.

BRIEF DESCRIPTION OF THE DRAWINGS

In order to completely understand the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are therefore not to be considered limiting of its scope, the invention will be described with additional specificity and detail through the use of the accompanying drawings in which.

DETAILED DESCRIPTION OF THE PREFERRED EMBODIMENTS

Figure 1:
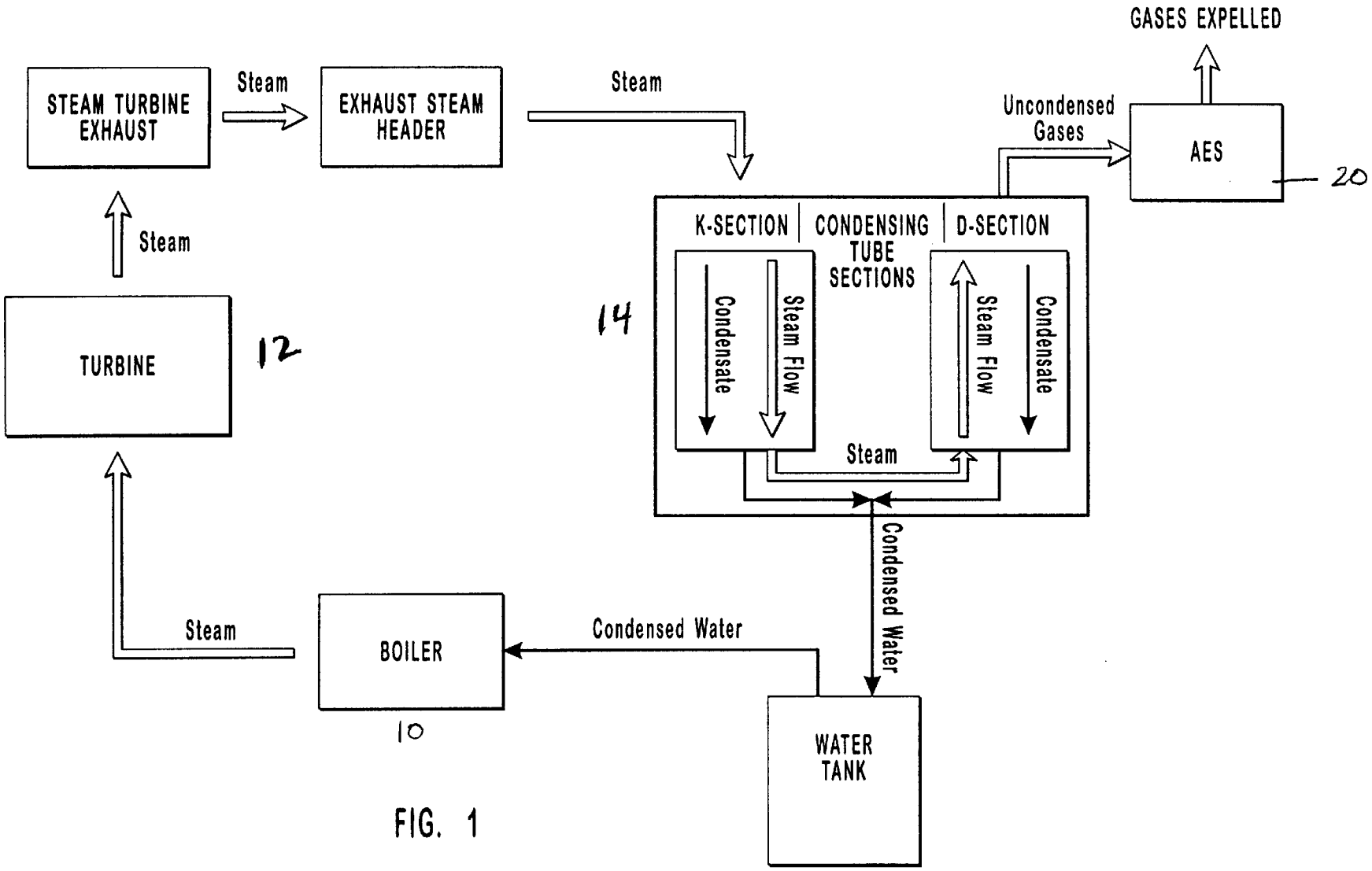
FIG. 1 is a diagram of a steam turbine power plant.
Figure 2:
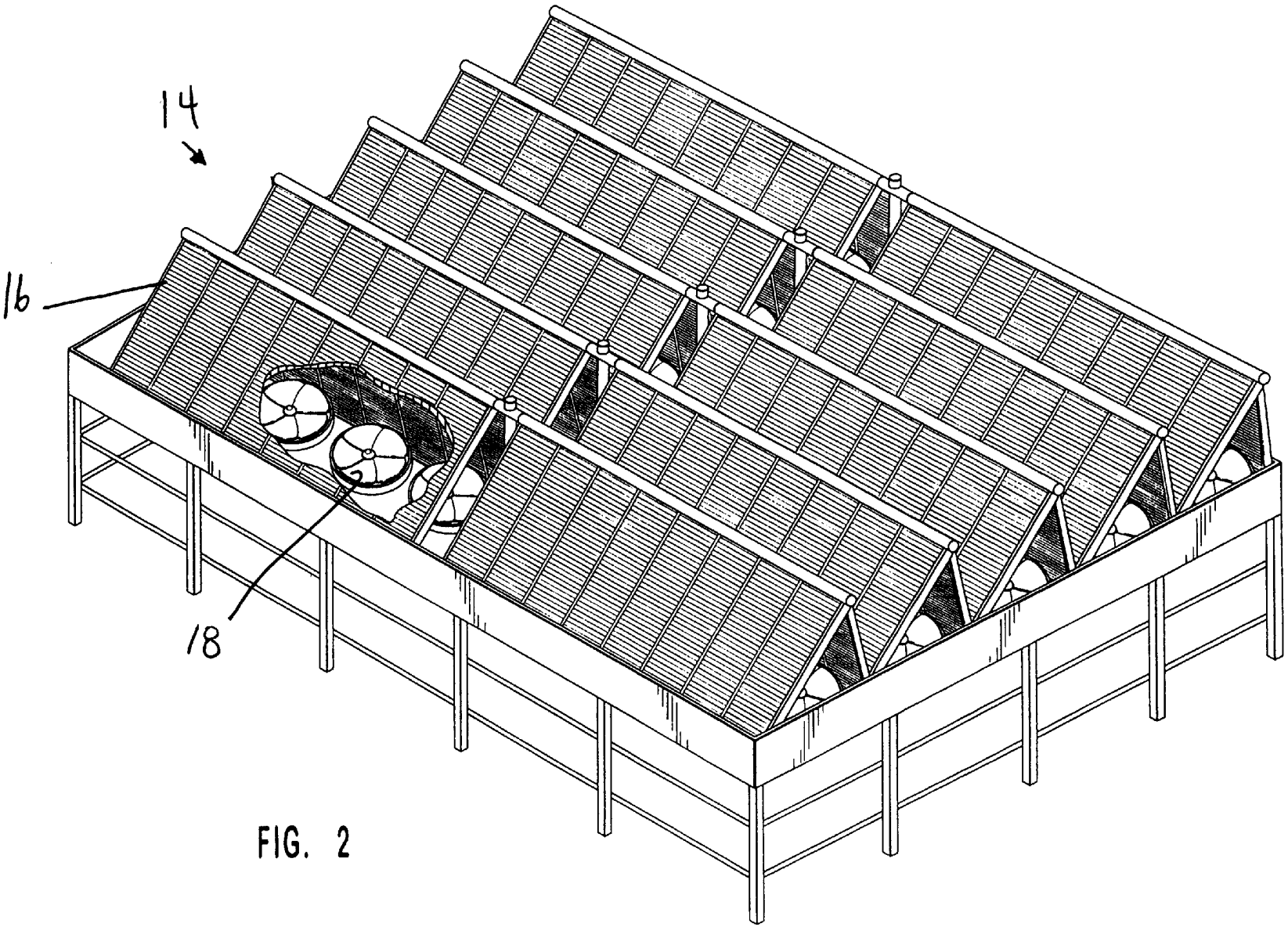
FIG. 2 is a perspective view of an air-cooled condenser with a cutaway showing the fans beneath the condensing tubes.

The present invention is directed to a device and method for allowing the energy efficiency of a power plant subsystem to be more effectively regulated thereby increasing the efficiency of the plant's electrical output. In broad terms, the invention provides for monitoring the power consumption of a subsystem which can directly influence the plant's electrical output, monitoring generator output as a function of a measurable condition related to generator output to obtain a calculated generator output value, comparing the generator output value to the power consumption of the subsystem, and adjusting the work output and energy consumption of the subsystem to regulate the energy efficiency of the subsystem to optimize the working conditions of the subsystem.

A primary focus of the present invention is to increase the energy efficiency of subsystems which directly influence electrical plant output. To do so it is important to monitor how much power the subsystem is using relative to the generator output. Monitoring the power or energy consumption of the subsystem can be accomplished using electrical metering devices known in the art.

One requirement of the present invention is that the subsystem being monitored must influence or effect the measured condition used to calculate the generator output value. For example, in the preferred embodiment of the present invention, an air-cooled condenser is the subsystem monitored and regulated for energy efficiency and condenser back pressure is the measured condition used to calculate a generator output value. As required by the invention, the air-cooled condenser is a subsystem capable of influencing or effecting back pressure, the measured condition. Specifically, the air-cooled condenser can directly affect back pressure; as the condenser fan speed increases, the temperature of the condenser tubes decreases and more steam is condensed, thereby reducing the back pressure. In this way, the condensing subsystem directly influences generator output. Attempting to regulate efficiency of a controllable, adjustable subsystem using a measured condition which is unrelated to the subsystem may fail to sufficiently isolate the calculated generator output value and may introduce external factors which would compromise the attempt to optimize energy efficiency.

It is advantageous if the subsystem is capable of being adjusted to various levels of power usage. In subsystems in which the power consumption is not freely variable, the ability to regulate the subsystem for energy efficiency is limited. In the preferred embodiment of the present invention, the air-cooled condenser employs variable speed fans to cool the condenser. Because the variable speed fans are not limited to discrete adjustments in speed and corresponding power consumption, the variable speed fans allow the operator to adjust the fan speed precisely for energy efficient use of the fans.

In addition to monitoring power consumption of a subsystem, the present invention provides for monitoring generator output of the plant. The present invention advantageously monitors generator output value in a manner that is effectively isolated from external factors. To accomplish this, rather than directly measuring generator output as influenced by uncontrollable or unquantifiable external factors, the present invention monitors generator output as a function of one or more measurable conditions related to generator output. The condition measured is not actual or gross generator output. Measurable conditions which are direct indications of gross generator output or fluctuations in actual generator output and which do not yield an effectively isolated generator output value are not the measured condition. By monitoring generator output as a function of a related measurable condition, a generator output value which is relatively isolated from external factors can be obtained. In the preferred embodiment, the related measurable condition is back pressure influencing the generator.

The measurable condition must have a quantifiable relationship to generator output or be indicative of generator output and must yield a generator output value which is isolated from external factors not related to the controllable subsystem efficiency. Preferably, the measured condition has a quantifiable relationship to generator output that allows an ideal or optimum generator output to be calculated using the measured condition. The ideal generator output is based upon or specifically takes into account the measured condition. The measurable condition is used to calculate, identify or obtain a generator output value isolated from other external factors. Because the measurable condition is "indirectly" indicative of generator output, the generator output value is not subject to as many external factors and is less likely to compromise energy efficiency as would an output value based on actual or gross generator output. Eliminating the impact or influence of external factors on the generator output value is an important advantage the present invention possess over the prior art.

Means for monitoring the measurable condition is also contemplated and includes metering devices known in the art. As stated, in the preferred embodiment of the present invention, back pressure is the measurable condition and is controllable by selectively regulating an air-cooled condenser. Back pressure is an appropriate measured condition because back pressure has a quantifiable relationship to generator output. Means for measuring back pressure can be any standard pressure gauge or pressure transmitter known in the art. The back pressure measurements are preferably taken near the turbine exhaust, but may be taken at other appropriate locations.

In order to obtain a value for generator output from the measured condition, the value for generator output may be calculated as a function of the measured condition. Because the measured condition has a quantifiable relationship to the generator output, the generator output generally can be expressed as a function of the measured condition. In the preferred embodiment of the present invention in which back pressure is the measured condition, a generator output value is obtained using a back pressure loss curve. A back pressure loss curve provides information about the power losses experienced by a generator for a charge in back pressure of a given back pressure. Using a back pressure loss curve, a function indicating the power saved per back pressure reduction can be developed. See FIG. 3. This mathematical relationship can be incorporated into devices, methods and uses of the present invention through microprocessor circuitry, software or other methods and can be used to calculate an isolated generator output value for given a back pressure. Different measurable conditions may have different quantifiable relationships to generator output, so the specific means for obtaining the calculated generator output value may differ depending upon the appropriate or chosen measured condition. Such means may include information indicating expected generator performance under controlled conditions, such as values obtained during the manufacturer's performance testing of the generator.

The present invention contemplates comparing the power consumption of the subsystem with a calculated generator output value. Various methods for comparing the generator output to power consumption are contemplated. In one embodiment of the invention, incremental increases in power consumption of the subsystem are compared to corresponding incremental increases in calculated generator output value. Similarly, fluctuations in the power consumption may be monitored and compared to fluctuations in the calculated generator output value. For example, in the preferred embodiment of the present invention the standard deviation of the power consumption of a condenser subsystem is compared to a generator output value based on the standard deviation of back pressure. The sample rate for monitoring fluctuations in the measured condition should be high enough that the value obtained reliably and accurately reflects the state of the measured condition. However, the period of time over which the sample rate is taken is not so long as to make regulating back pressure ineffective.

In order to compare the value of the power consumption of the subsystems with the calculated generator output value means for comparing is provided, for example, the values may be transmitted to a control system. The values compared reflect the energy efficiency of the fans. The comparison shows whether an incremental increase in subsystem power consumption exceeds the corresponding incremental increase in generator output. If so, the generator is no longer operating in an efficient range and adjustments should be made so that the subsystem operates efficiently. Conversely, when incremental increase in power consumption of the subsystem does not equal or exceed the corresponding incremental increase in generator output, the generator may be operating at an inefficient level under capacity. Similarly, if fluctuations in power consumption of the subsystem and generator output are being monitored and compared, when fluctuations in generator output are lower or occur at a lower rate than do fluctuations in power consumption of a subsystem, the subsystem may not be operating in an efficient range.

In the preferred embodiment of the present invention, the standard deviation of the generator output value based on back pressure (the measured condition) is compared to the standard deviation of the power consumption of an air-cooled condenser to yield an optimizer value. The optimizer value is defined as the standard deviation of the calculated generator output subtracted from the standard deviation of the subsystem power consumption. A negative optimizer value indicates that power consumption of the subsystem may be increased. When the optimizer value is zero then fluctuations in subsystem power consumption substantially equal the fluctuations in the generator output value, and the system is running optimally. A positive optimizer value indicates the power consumption of the subsystem should be decreased. In other words, when the optimizer value is zero, if fan speed is increased, more energy is used than is gained by the corresponding reduction in back pressure. Using the optimizer value as an indicator of energy efficiency, the power consumption of the condenser can be regulated to achieve optimum back pressure and thereby optimal efficient electrical consumption and generator output.

After comparing the generator output to the power consumption of the subsystem, adjustments can be made so that the subsystem operates more efficiently relative to the generator. The adjustments are made using a means for adjusting power consumption such as control system. For example, a control system may run automatically by microprocessor circuitry, software or other means of adjusting and controlling the efficiency of the subsystem's power consumption. On the other hand, adjustments can be made directly to the subsystem power consumption, resulting in an appropriate change in power consumption such as adjusting fan speed when the regulated subsystem is an air-cooled condenser. Alternatively, the invention also contemplates making adjustments that more indirectly affect the efficiency of subsystem power consumption such as adjusting the amount of steam entering a condenser.

In the preferred embodiment of the present invention, adjustments are made in the power consumption of the air-cooled condenser using the back pressure set point. The back pressure set point is a predetermined value for the desired back pressure in the condenser. Back pressure is monitored in the condenser subsystem and when the monitored back pressure is not at the desired value relative to the back pressure set point, fan speed is increased or decreased accordingly, to regulate the back pressure. In a similar fashion the back pressure set point can be used to regulate the power consumption of the condenser. If fluctuations in the power consumption are greater than fluctuations in generator output, then the differential increase in power consumption will be greater than the differential increase in generator output, which means the system is generating a net power loss. To remedy this situation, the back pressure set point can be increased, which will decrease fan speed and run the generator more efficiently. When the converse is true, the back pressure set point is decreased causing the condenser cooling rate to increase.

Because the present invention operates to control and regulate the energy efficiency of the subsystem, if the devices or methods of the present invention malfunctions, the malfunction may cause inefficient regulation of the system. To prevent a malfunction from inappropriately adjusting the subsystem, the present invention also provides means for limiting erroneous regulation of the subsystem by an automated control system. The means for limiting improper regulation restricts the influence the optimizer value has on regulating the subsystem according to the situation. When regulation by the invention is inappropriate and results in unacceptable inefficiency in the subsystem, regulation by the invention is discontinued. The system may then be regulated manually or if preferred automatically but in accordance with predetermined guidelines for the given situation. For obvious reasons, it is advantageous under such situations, that the system be operated free from improper regulation by the invention.

In the preferred embodiment of the present invention, means for limiting improper regulation comprises means for limiting the range of adjustment which can be made using the back pressure optimizer value. To prevent improperly adjusting the power consumption in the condenser, the range of adjustment made using the back pressure optimizer value is limited to a range of predetermined back pressure values. These controlling back pressure values are additional default set points which vary according to ambient temperatures. The back pressure set points form a curve which is used to calculate an upper and lower limit for back pressure based on the given ambient temperature. The upper and lower limits prevent the back pressure optimizer value from improperly adjusting back pressure too high or too low.

In the preferred embodiment of the present invention the back pressure set point is typically adjusted according to the calculation of the back pressure optimizer value. However, to prevent improper regulation, before the set point is adjusted according to the optimizer value calculations, the back pressure set point based on the optimizer value is compared to a standardized back pressure value found on a back pressure set point curve. The standardized back pressure value is based on the ambient temperature. The adjustment in back pressure by the optimizer value is limited so that the back pressure set point can only diverge from the back pressure set point curve by plus or minus one inch mercury of pressure which is plus or minus one inch mercury from the standardized back pressure value for the given ambient temperature.

Table 1 shows a sample of standardized back pressure values taken from a back pressure set point curve based on ambient temperature. Use of this table under the principles of the present invention would be as follows. If for example, the present ambient temperature is zero degrees Fahrenheit, the subsystem back pressure in the condenser is 7.20 inches Hg and the optimizer value indicates that the back pressure should be increased and the fan speed lowered, then the highest the back pressure set point could be raised is one inch of Hg above the standardized 6.25 inches of Hg, i.e., to 7.25 inches of Hg. Similarly, under the same temperature and back pressure conditions, the lowest value to which the set point could be adjusted is one inch Hg less than 6.25, or 5.25 inches Hg, using the curve represented in Table 1. The values of the standardized curve may differ for different generators and condensers.

TABLE 1

Optimizer-Minimum Back Pressure Set Point

| Temperature (Degrees F.) | Minimum Back Pressure (Inches Hg) |
|---|---|
| −40 | 7 |
| 0 | 6.25 |
| 10 | 6 |
| 20 | 5 |
| 30 | 5 |
| 60 | 5.5 |

Fluctuations in power consumption of a subsystem are sometimes reduced or eliminated as the subsystem approaches operating at full capacity. When the fans reach full speed, then fluctuations in fan power consumption can be reduced to near zero, resulting in a greatly negative optimizer value. Similarly, when the fans reach their current limit, fluctuations in the power consumption readings begin to decrease, and the optimizer may yield an inaccurate negative value. Because a negative optimizer value normally indicates fan speed is too low, when the optimizer value calculation generates a negative value at a time when fans are running at full speed, the negative optimizer value is probably inappropriate for the conditions. Under these circumstances, the optimizer function of some embodiments breaks down.

Because of this difficulty, the present invention provides additional means for limiting improper regulation by the invention comprising means for substituting a more appropriate back pressure set point when the optimizer value is misleadingly negative. In the present invention, means for monitoring fan motor capacity is provided. When the means for monitoring indicates the fan motors are running near full speed, the back pressure optimizer is disengaged and no longer regulates fan speed. An appropriate back pressure set point value can be used to replace the optimizer value. In the preferred embodiment of the present invention, at a chosen fan speed output level of 94% (the current limit for some motors), the optimizer stops regulating the fan speed and a standardized back pressure value from the back pressure set point curve is used as the back pressure set point for the given ambient temperature.

In a preferred embodiment, means for monitoring power consumption of a subsystem, means for means for monitoring generator output as function of a measured condition, means for comparing and means for adjusting the power consumption of a subsystem utilize a computerized controller linked to input and output devices. The input devices may include one or more pressure transmitters. The computerized controller may be a part of a larger distributed, digital control system. The distributed control system may be any suitable control system commercially available capable of accomplishing the functions to be herein described. Furthermore, the individual components of the control system may be hardware components readily available. Briefly, in one presently preferred embodiment, the present invention is accomplished through use of the Bailey Network 90® controller available from Bailey Controls. Of course, it will be appreciated by those skilled in the art that a variety of computerized systems may be used to accomplish the functions to be described herein.

Figure 4:
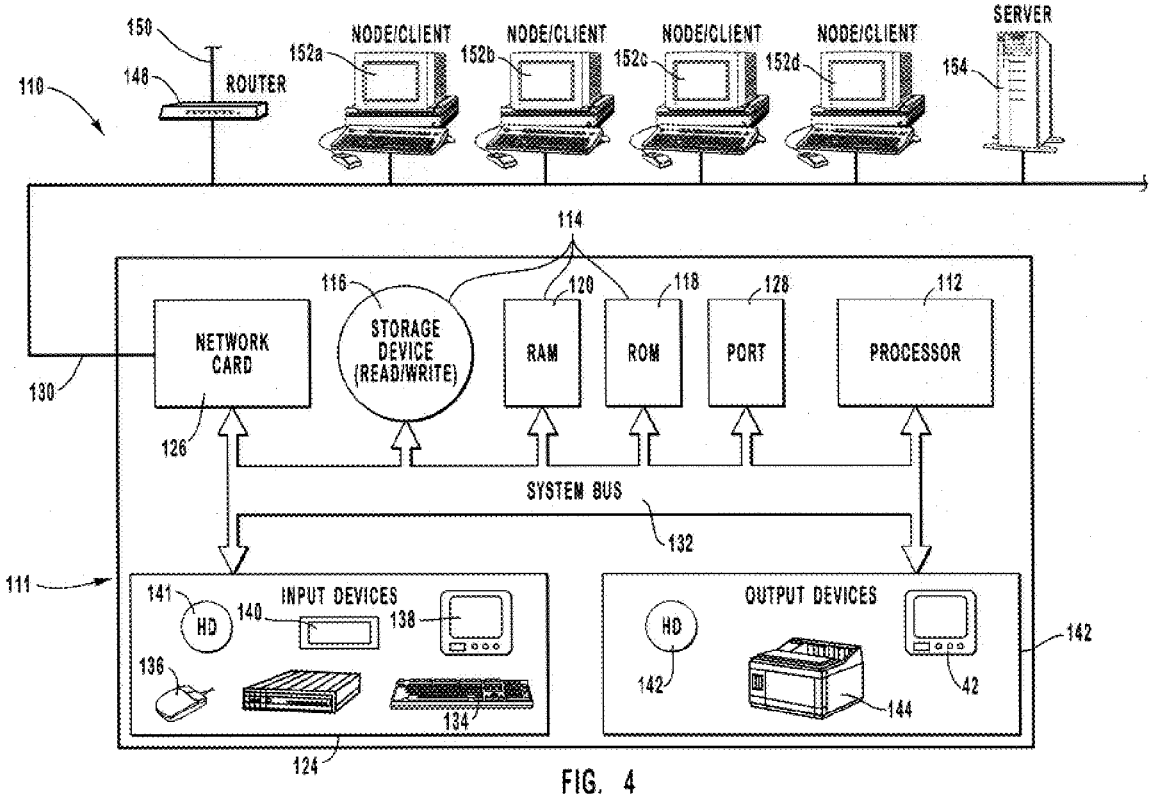
FIG. 4 is a block diagram of one embodiment of a network used to carry out the present inventing is a flow chart illustrating some of the features of the back pressure control system.

It will be appreciated that a variety of hardware and/or software components may be utilized to accomplish the present invention. FIG. 4 illustrates an apparatus that may be used in accordance with the present invention to increase the efficiency of a power plant subsystem. Generally, the apparatus as shown in FIG. 4 functions as a computer with inputs being fed into it thereby allowing the computer to regulate the power consumption of a power plant subsystem by controlling the subsystem operation and other necessary hardware through outputs. The computer may be connected to a computer network to enable interactions with other computers, hardware, and software to accomplish other necessary tasks. In addition, the present invention may be accomplished by cooperating computers, software, and/or hardware which are interconnected through communication means. The communication means may be accomplished through a computer network, by wireless transmission, or the like.

Referring to FIG. 4, an apparatus 110 may implement the invention on one or more computers 111 containing a processor 112 or CPU 112. All components may exist in a single computer 111 or may exist in multiple computers 111, 152 remote from one another. The CPU 112 may be operably connected to a memory device 114. A memory device 114 may include one or more devices such as a hard drive or nonvolatile storage device 116, a read-only memory 118 (ROM) and a random access (and usually volatile) memory 120 (RAM).

The apparatus 110 may include an input device 122 for receiving inputs from a user or another device, such as a pressure sensor, a temperature sensor, a switch, etc. Similarly, an output device 124 may be provided within the computer 111, or accessible within the apparatus 110. A network card 126 (interface card) or port 128 may be provided for connecting to outside devices, such as the network 130.

Internally, a bus 132 may operably interconnect the processor 112, memory devices 114, input devices 122, output devices 124, network card 126 and port 128. The bus 132 may be thought of as a data carrier. As such, the bus 132 may be embodied in numerous configurations. Wire, fiber optic line, wireless electromagnetic communications by visible light, infrared, and radio frequencies may likewise be implemented as appropriate for the bus 132 and the network 130.

Input devices 122 may include one or more physical embodiments. For example, a keyboard 134 may be used for interaction with the user, as may a mouse 136 or stylus pad 137. A touch screen 138, a telephone 139, or simply a telephone line 139, may be used for communication with other devices, users, or the like. Similarly, a scanner 140 may be used to receive graphical inputs which may or may not be translated to other character formats. A memory device 141 of any type (e.g., hard drive, floppy, etc.) may be used as an input device, whether resident within the node 111 or some other node 152 on the network 130, or from another network 150. One or more switches may be fed into the computer 111 as input devices 122.

Output devices 124 may likewise include one or more physical hardware units. For example, in general, the port 128 may be used to accept inputs and send outputs from the node 111. A monitor 142 may provide outputs to a user for feedback during a process, or for assisting two-way communication between the processor 112 and a user. A printer 144 or a hard drive 146 may be used for outputting information as output devices 124. Another output device 124, such as a back pressure set point or temperature set point (not shown) may be connected to and controlled by the computer 111. In addition, a control line (not shown) controlling fan speed may also be connected to the computer 111.

In general, a network 130 to which a computer 111 (or node 111) connects may, in turn, be connected through a router 148 to another network 150. In general, two nodes 111, 152 may be on a network 130, adjoining networks 130, 150, or may be separated by multiple routers 148 and multiple networks 150 as individual nodes 111, 152 on an internetwork. The individual nodes 152 (e.g., 111, 152, 154) may have various communication capabilities.

In certain embodiments, a minimum of logical capability may be available in any node 152. Note that any of the individual nodes 111, 152, 154 may be referred to, all together, as a node 111 or a node 152. Each may contain a processor 112 with more or less of the other components 114–144.

A network 130 may include one or more servers 154. Servers may be used to manage, store, communicate, transfer, access, update, and the like, any practical number of files, databases, or the like, for other nodes 152 on a network 130. Typically, a server 154 may be accessed by all nodes 111, 152 on a network 130. Nevertheless, other special functions, including communications, applications, directory services, and the like may be implemented by an individual server 154 or multiple servers 154. A node 111 may be a server 154.

In general, a node 111 may need to communicate over a network 130 with a server 154, a router 148, or nodes 152 or server 154. Similarly, a node 111 may need to communicate over another network (150) in an internetwork connection with some remote node 152. Likewise, individual components 112–146 may need to communicate data with one another. A communication link may exist, in general, between any pair of devices.

Those of ordinary skill in the art will, of course, appreciate that various modifications to the diagram of FIG. 4 may easily be made without departing from the essential characteristics of the invention, as described herein. Thus, the following description of the functionality required by the apparatus used by the present invention is intended only by way of example, and simply illustrates certain presently preferred embodiments consistent with the invention as claimed herein.

As stated, in one presently preferred embodiment, the computer 111 may be a commercially available controller. In current design, the controller 111 is a Bailey Network 90®. The controller 111 may be connected to various input and output devices directly, through a port 128, over a network 130, or by other suitable means. In an alterative design, a Bailey Infi 90 may be used. The presently preferred controller is roughly the equivalent of a stand-alone computer without the added complexity. The current controller is capable of handling many inputs and outputs, and comes with a variety of useful, built-in features. Presently, functions available with the Network 90 were used in implementing the present invention. For example, a PID function, PID controller block, was used in accomplishing the present invention. Of course, it will be appreciated by those skilled in the art that a different means for accomplishing the present invention could be used. For example, an IBM-compatible computer could have the necessary input and output interfaces installed to accomplish the present invention. In addition, the software required to accomplish the present invention could be written without the use of standard library functions available on the Network 90, and without the use of library functions available by many compilers used by those skilled in the art.

Figure 3:
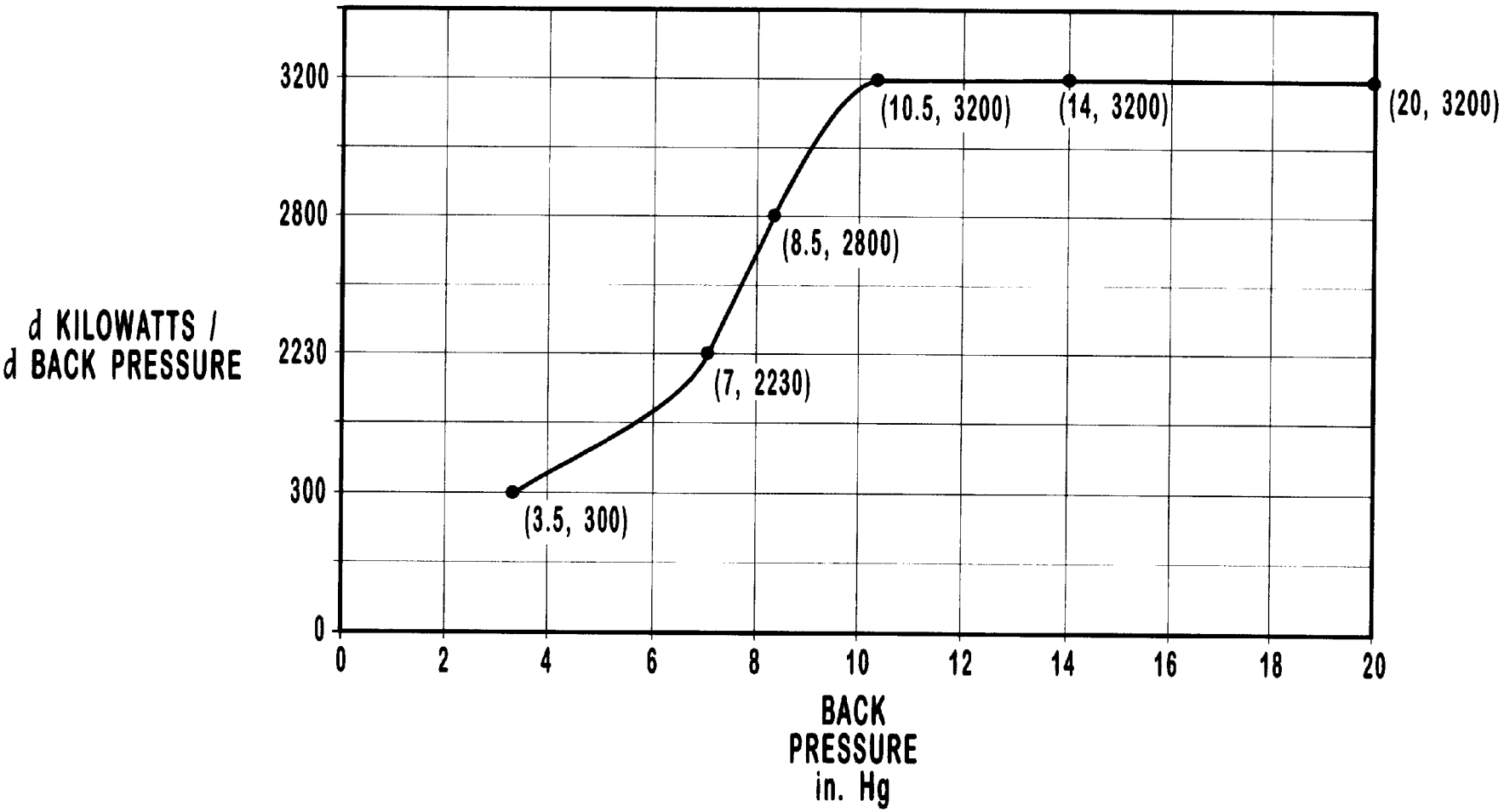
FIG. 3 is a graph showing the relationship between the derivative of kilowatts over the derivative of back pressure to back pressure.
Figure 5:
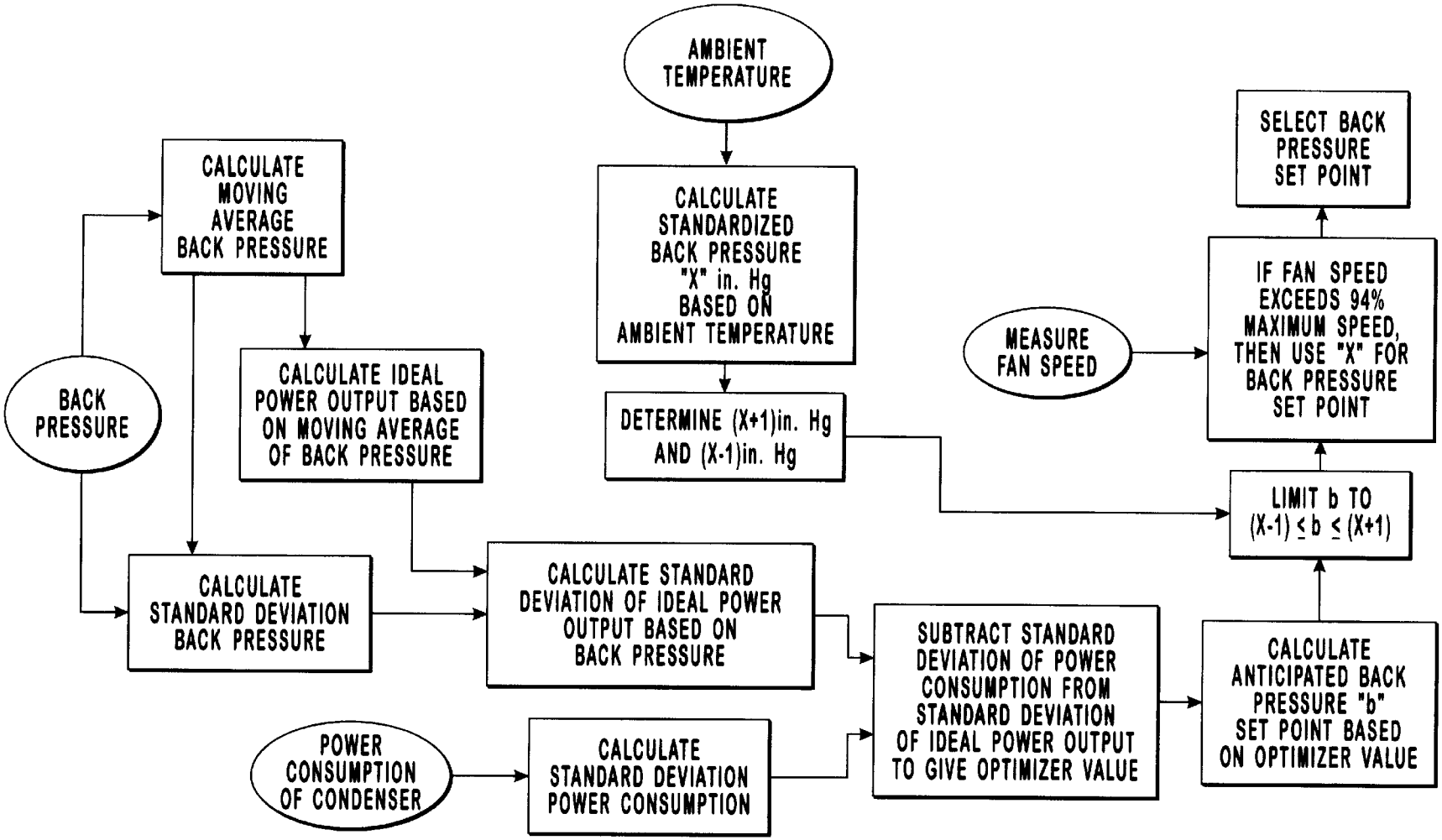
FIG. 5 is a flow chart illustrating one embodiment of the present invention.

Various embodiments of the present invention are contemplated. In one example of the present invention diagramed in FIG. 5, a back pressure set point for the air-cooled condenser is selected. The air-cooled condenser subsystem will operate in an attempt to maintain the selected back pressure. Power consumption of the condenser will fluctuate, as will the back pressure. During this time, the present invention will measure the standard deviation of the back pressure in the air-cooled condenser. The back pressure is measured 60 times during a 15 minute period using pressure transmitters. The values measured over that 15 minute period are used to calculate the standard deviation of the back pressure. The readings are transmitted to a PID controller connected to the transmitter. The standard deviation of the back pressure can then be used to obtain a calculated generator output. This is done by multiplying the standard deviation with an output multiplier that yields a product in power units. The output multiplier with which the standard deviation is multiplied is obtained using a kilowatt curve that converts changes in back pressure into corresponding generator power loss or gain. FIG. 3 shows a graph of such a kilowatt curve. The mathematical operations are performed by the PID controller.

During this period of time, the power consumption of the air-cooled condenser is also being monitored. The standard deviation of the power consumption is monitored in a manner similar to that of the back pressure in the air-cooled condenser. Sixty measurements of power consumption are taken during a 15 minute period in order to arrive at the standard deviation for power consumption. The power consumption transmitter is connected to the PID controller and relays the power consumption reading to the PID control unit which performs the necessary calculations.

The standard deviation of the calculated generator output is then compared to the standard deviation of power consumption in the condenser. This comparison is done using the PID controller which subtracts the standard deviation of power consumption from the standard deviation of the calculated generator output yielding the back pressure optimizer value. Where the standard deviation of the calculated generator output is greater than that of the power consumption of the condenser, the back pressure optimizer value is positive, indicating that fan speed can be increased. Where the standard deviation of the power consumption of the condenser is greater than the standard deviation of the calculated generator output, the back pressure optimizer value will be negative, indicating that the condenser is consuming more energy than it is saving. Therefore, power consumption in the condenser should be reduced.

Adjustments in the power consumption of the condenser based on the optimizer value are made using the PID controller to increase or decrease the back pressure set point, which in turn increases or decreases the condenser fan speed. In order to maintain proper regulation of the condenser and to prevent inaccurate optimizer values from improperly adjusting the power consumption of the condenser, the range of adjustment to the back pressure set point based on the optimizer value is limited by a standardized back pressure set point curve. The back pressure set point curve of the present invention allows the back an adjustment in the air-cooled condenser back pressure based on the optimizer value of plus or minus one inch Hg from the standardized back pressure value for a given ambient temperature. Ambient temperature readings are taken and transmitted to a control unit which, based on the temperature readings, establishes the range for which the value back pressure power consumption can be adjusted and then compares the prescribed range to the set point calculated using the optimizer value.

When the fan speed is increased in order to lower the back pressure, the condenser fans can be run at near maximum speed. The maximum fan speed may be based on the maximum fan speed hertz or on the power current limit for the fan motor. However, as the condenser fans approach maximum speed, the fluctuations in the power consumption begin to diminish, which leads to an inaccurate negative back pressure optimizer value. In order to prevent this inaccurate value from incorrectly adjusting the back pressure set point, the fan speed is monitored using a fan speed controller unit. The speed control unit is so that as the fans approach maximum speed, the use of the back pressure optimizer value is phased out. As the fans approach 94 percent of fan speed, which is near the current limit for the fan motor, the back pressure optimizer value is phased out and the standardized back pressure values on the back pressure set point are used for the back pressure set point.

When the fans reach 94 percent of maximum fan speed, a transfer function will slowly phase out the control signal from the back pressure optimizer value. A high-low switch prevents the system from sporadically switching back and forth between the back pressure set point curve and the back pressure optimizer. Once the fan has hit 94percent of maximum fan speed, the back pressure optimizer may discontinue regulating the system for about 30 minutes before attempting to regulate the system again. A time delay switch allows for a slow transfer between the back pressure optimizer and the back pressure set point curve when the fans are approaching full speed. This helps to prevent sporadic, discreet step changes in the regulation of the system.

The application of the device and method of the present invention is not limited to the preferred embodiment described. While one preferred embodiment of the invention utilizes the relationship between back pressure and calculated generator output to regulate energy efficiency of a condenser, a different quantifiable relationship between a measurable condition and the calculated generator output could be used to regulate the energy efficiency of a different power plant subsystem, where the subsystem influences or effects the measurable condition. Such conditions might include boiler temperatures, steam pressure, fan speed, or other conditions, provided such conditions have a quantifiable relationship with the generator output. Monitoring and regulating a subsystem power consumption by means of a measured condition allows plant operators to achieve and maintain optimum operation of the subsystem. Employing the present invention may not require significant changes in the operation of the plant and is preferably automated so the invention can be simple and relatively easy to install, operate and maintain.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States patent is:

1. A method for regulating the energy efficiency of a power plant subsystem comprising the steps of:

monitoring a calculated generator output as a function of a measurable condition;

comparing the calculated generator output with power consumption of a subsystem affecting the measurable condition; and adjusting the subsystem to run more energy efficiently wherein the step of monitoring power consumption further comprises monitoring fluctuations in power consumption of a subsystem influencing the measurable condition; the step of monitoring calculated generator output further compromises monitoring fluctuations in a generator output of a power plant generator as a function of fluctuations in a measurable condition; the step of comparing power consumption to generator output further comprises comparing the fluctuations in power consumption of the subsystem to the fluctuations in the calculated generator output; and the step of adjusting the subsystem further comprises adjusting the subsystem to substantially equalize fluctuations in the power consumption of the subsystem with fluctuations in the calculated generator output.

2. A method as described in claim 1 wherein the measurable condition further comprises a condition having a quantifiable relationship to generator output; and the measurable condition being directly influenced by the subsystem.

3. A method as described in claim 1 wherein the step of comparing the power consumption with generator output further comprises comparing the standard deviation of a calculated generator output with standard deviation of subsystem power consumption.

4. A method as described in claim 1, further comprising the steps of:

comparing the generator output with the power consumption by calculating an optimizer value, adjusting the power consumption of the subsystem using the optimizer value; and limiting regulation by the optimizer value when the optimizer value is inaccurate.

5. A method as described in claim 1 wherein the measurable condition is back pressure and the subsystem is an air cooled condenser.

6. A device for regulating the efficiency of the power plant air cooled condenser comprising:

means for monitoring a back pressure, the back pressure having a quantifiable relationship to generator output and being affected by the air cooled condenser, said means calculating the standard deviation of the back pressure;

means for monitoring back pressure, said means calculating the standard deviation of the back pressure;

means for comparing the standard deviation of power consumption of the air cooled condenser with the standard deviation of the back pressure by converting back pressure into a calculated value for generator output and generating an optimizer value; and means for adjusting the air cooled condenser power consumption based on the optimizer value by adjusting a back pressure set point which regulates the condenser back pressure.

7. The device as described in claim 6 further comprising:

means for monitoring fan speed capacity to anticipate when an optimizer value is misleadingly negative;

means for substituting a back pressure set point value for the set point generated by the optimizer value when the optimizer value is misleadingly negative; and means for limiting the range of adjustment to the back pressure set that the optimizer value is capable of making.

* * * * *

UNITED STATES PATENT AND TRADEMARK OFFICE

CERTIFICATE OF CORRECTION

PATENT NO. : 6,128,905
DATED : October 10, 2000
INVENTOR(S) : Paul M. Fahlsing

It is certified that error appears in the above-identified patent and that said Letters Patent is hereby corrected as shown below:

Abstract:
Line 10, should read: "is compared to generator output." instead of "is compared to generator."
Line 11, should read: "can then be adjusted." instead of "can then be adjusted output."

Column 3,
Line 12, should read: "at higher speeds consumes" instead of "at higher speeds consume"

Column 5,
Line 35, should read: "the present invention" instead of "the present inventing"
Line 66, should read: "influence or affect" instead of "influence or effect"

Column 6,
Line 67, should read: "possesses over the prior art" instead of "possess over the prior art"

Column 7,
Lines 30-31, should read: "for a given back pressure" instead of "for given a back pressure"

Column 10,
Line 47, should read: "means for monitoring" instead of "means for means for monitoring"

Column 13,
Line 58, should read: "allows the back end" instead of "allows the back an"

UNITED STATES PATENT AND TRADEMARK OFFICE

CERTIFICATE OF CORRECTION

PATENT NO. : 6,128,905
DATED : October 10, 2000
INVENTOR(S) : Paul M. Fahlsing

It is certified that error appears in the above-identified patent and that said Letters Patent is hereby corrected as shown below:

Column 14,
Line 4, should read: "affects the measurable condition" instead of "effects the measurable condition"

Signed and Sealed this

Thirteenth Day of November, 2001

*Attest:*

Nicholas P. Godici

NICHOLAS P. GODICI
*Acting Director of the United States Patent and Trademark Office*

*Attesting Officer*